United States Patent [19]

Fidi

[11] Patent Number: 4,817,168

[45] Date of Patent: Mar. 28, 1989

[54] DIRECTIONAL MICROPHONE

[75] Inventor: Werner Fidi, Baden, Austria

[73] Assignee: AKG Akustische u. Kino-Geräte Gesellschaft m.b.H., Vienna, Austria

[21] Appl. No.: 27,171

[22] Filed: Mar. 17, 1987

[30] Foreign Application Priority Data

Mar. 20, 1986 [AT] Austria ..... 744/86

[51] Int. Cl.[4] ..... H04R 9/08

[52] U.S. Cl. ..... 381/155; 381/159; 381/162; 381/168; 381/191; 181/160

[58] Field of Search ..... 381/168, 169, 153, 154, 381/155, 156, 157, 159, 159, 160, 162, 184, 186, 187, 202, 203, 191; 379/420, 432; 181/160, 163, 164, 165, 166

[56] References Cited

U.S. PATENT DOCUMENTS 2,627,558 2/1953 Wiggins ..... 381/155
3,115,207 12/1963 Wiggins ..... 381/155
4,054,748 10/1977 Balogh ..... 381/155
4,340,787 7/1982 Görike ..... 381/155

FOREIGN PATENT DOCUMENTS 0821217 7/1949 Fed. Rep. of Germany .
0251667 1/1967 Fed. Rep. of Germany ..... 381/168

*Primary Examiner*—John W. Caldwell, Sr.
*Assistant Examiner*—Tyrone Queen
*Attorney, Agent, or Firm*—Toren, McGeady & Associates

[57] ABSTRACT

A directional microphone operating according to the electrostatic or electrodynamic transducer principle. The pickup effect of the microphone is determined by a single phase-shifting delay line section between the rear side of the active transducer diaphragm and at least one sound entry opening provided in the microphone housing at a distance behind the plane of the diaphragm. The microphone includes at least one acoustic element coupled to the delay line section. The delay line section is arranged with the acoustic element or elements so as to have a lower limit frequency in the range of 300 Hz.

5 Claims, 4 Drawing Sheets

DIRECTIONAL MICROPHONE

BACKGROUND OF THE INVENTION

1. Field of the Invention

The present invention relates to a directional microphone operating according to the electrostatic or electrodynamic transducer principle. In such a directional microphone, the pickup effect is determined by at least one phase-shifting delay line section between the rear side of the active transducer diaphragm and at least one sound entry opening provided in the housing at a distance behind the plane of the diaphragm. The directional microphone includes at least one accoustic element coupled to the delay line section.

2. Description of the Prior Art

Directional microphones are known and described, for example, in German Pat. No. 821 217. These directional microphones have several undesirable disadvantages. Since the phase-shifting delay line sections are generally designed in such a way that they are effective over the entire range of audibility, the frequency response and the sensitivity are impaired because of the compromises which must be made. The close talking effect which occurs in these direction microphones constructed as pressure-gradient sound pickups is particularly troublesome. The close talking effect resides in that an extreme sensitivity increase occurs in the bass range which substantially falsifies the sound impression. In addition, the pressure-gradient pickups are particularly sensitive to explosive sounds which lead to the so-called pop noise.

In other prior art directional microphones of the same type, additionally acoustic elements are included which are coupled to the delay line section. In these cases, the pickup pattern is influenced and changed. In the prior art references directed to these directional microphones, the problem of the close talking effect is not addressed. Due to the construction of these microphones, this problem does not arise.

It is, therefore, the primary object of the present invention to provide a directional microphone which avoids the disadvantages of the known microphone with pickup pattern.

SUMMARY OF THE INVENTION

In accordance with the present invention, the finding is utilized that frequencies of approximately 300 Hz and below are contributing very little for locating a sound source. Thus, it is proposed in accordance with the present invention, to construct a directional microphone in such a way that it operates in the range of above 300 Hz as a pressure gradient pickup with pickup pattern, while in the range of below 300 Hz it operates as a pure non-directional pressure microphone. The limit frequency or frequency cutoff of 300 Hz referred to above is to be considered as an approximate average because, as is well known, the transition from pressure gradient pickup to pressure pickup does not occur suddenly but gradually.

Therefore, in accordance with the present invention, the arrangement of the delay line section with the acoustic element or elements coupled to the delay line section has a power limit frequency in the range of 300 Hz.

A directional microphone of this type has several advantages. By combining a pressure pickup for the low frequencies with a pressure gradient pickup for the high and highest frequency of the range of audibility, the frequency response is expanded toward the low frequencies. In addition, the close talking effect no longer occurs because pressure pickups are not subject to this effect. The result is a true and tone correct conversion of the low frequency portion of the sound occurrence to be transmitted.

Furthermore, explosive tones no longer result in pop noises because pressure pickups do not have the properties of pressure gradient pickups.

In addition, in the directional microphone according to the invention, the transmission factor is improved in the entire range of the audible frequencies because the frequency response of the microphone is raised by several dB in the low and middle frequencies in which the microphone operates as a pressure pickup and, thus, is adjusted to the level of the increase of the presence of a pressure gradient pickup which is otherwise present at high frequencies.

The increase of the transmission factor provides the additional advantage that the basic noise level is reduced by the value of the increase of the transmission factor. Although connections having such a limit frequency can be easily realized, it has been found that a number of concrete solutions exist which are particularly suitable for realizing the adjustment to such a limit frequency.

In accordance with the invention, the simplest concrete solution of the object of the invention resides in the arrangement of the delay line section and of the acoustic element or elements coupled thereto in a series connection of these elements, wherein the acoustic element may be an acoustic capacitance or a passive diaphragm. In the case of a capacitance, this capacitance is to be selected in such a way that at frequencies below about 300 Hz it delivers a phase shift of 180° in cooperation with the at least one delay line section, so that practically no sound pressure acts on the rear side of the active transducer diaphragm. The passive diaphragm, on the other hand, is to be adjusted in such a way that it becomes impermeable for frequencies below about 300 Hz. It is advantageous to provide a passive diaphragm at each of the rearward sound entry openings of the at least one delay line section, so that the passive diaphragms close the rearward sound entry openings.

The microphone then operates in either case in the range below 300 Hz as a pure pressure pickup and only above the proposed limit frequency of about 300 Hz it acts as a pressure gradient pickup with a distinct pickup pattern. The above-described series connection of an acoustic capacitance or passive diaphragm with the phase-shifting delay line section is particularly suitable for capacitor microphones.

Use of passive diaphragms is also particularly advantageous because these diaphragms can be divided by means of webs into diaphragm portions which have different natural resonances. This makes it possible for the skilled artisan to utilize a wide spectrum of dimensions.

Finally, the natural resonance of the passive diaphragm or diaphragms is to be higher than that of the active transducer diaphragm, so that any disadvantageous influence on the frequency response and the sensitivity of the microphone is avoided.

The transmission of the gradient pickup to pressure pickup can also be obtained by coupling several acoustic elements additionally with the at least one delay line section in a parallel connection. Preferably, a resonant circuit including at least two acoustic elements with an acoustic inductance and an acoustic capacitance will be used. At least one frictional resistance may be added to this circuit. Specifically, in a directional microphone according to the invention, the acoustic inductance may be a volume of air enclosed within a small tube, wherein the small tube ends together with the at least one delay line section in an air chamber located behind the transducer diaphragm. The other end of the small tube connects this air chamber with a large-volume hollow space in the microphone housing. This is a series resonant circuit which is connected in parallel with the at least one delay line section and which is dimensioned in such a way that it forms a short circuit for frequencies below about 300 Hz, so that the effect of the at least one delay line section is eliminated.

In accordance with another advantageous embodiment, the same series resonant circuit as described above is used, however, coupling is not effected through a common air chamber, but immediately at the delay line section itself, preferably at its frictional resistance.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
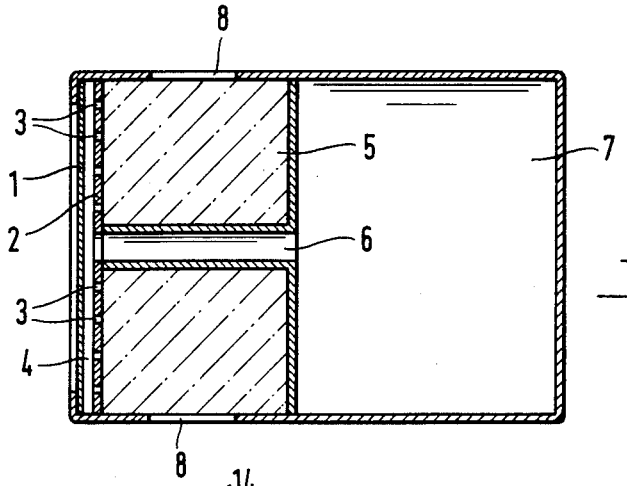
FIG. 1 is a schematic sectional view of a directional capacitor microphone according to the invention.

FIG. 1 of the drawing shows a first embodiment of the invention. Specifically, FIG. 1 shows a directional capacitor microphone with an active transducer diaphragm 1 and a back plate 2 spaced a small distance from diaphragm 1. Back plate 2 is provided with bores 3. The space between diaphragm 1 and back plate 2 defines a shallow air chamber 4. The width of air chamber 4 is such that diaphragm 1 can just freely oscillate relative to back plate 2. Reference numeral 5 denotes the phase-shifting delay line section. Reference numeral 8 denotes the sound entry openings which are located behind the diaphragm plane and lead to the delay line section 5.

The additional acoustic elements provided in accordance with the invention are an air body 6 enclosed within a small tube and an air volume 7 enclosed in a large-volume hollow space. Air volume 7 acts as an acoustic capacitance which forms a resonant circuit together with the air body 6 in the small tube which is to be considered an acoustic inductance. This resonant circuit as well as the delay line section 5 are coupled to the shallow air chamber 4 behind the diaphragm 1. The resonant circuit formed by the acoustic elements 6 and 7 represent the series connection of an inductance and a capacitance whose impedance becomes a minimum in the range of the resonant frequency.

In the embodiment illustrated in FIG. 1, the series connection of 6 and 7 is parallel to the delay line section 5, so that the latter is practically short-circuited in the range of the resonant frequeny of the series resonant circuit 6, 7. In other words, in this case, the delay line section 5 becomes ineffective relative to the transducer diaphragm 1 and, thus, the microphone can be considered a pure pressure pickup; this is the object of the invention. Of course, the resonance of the resonant circuit formed by elements 6 and 7 is to be set and damped in such a way that it covers the range of the lowermost frequencies to be transmitted, i.e., to about 300 Hz.

Figure 2:
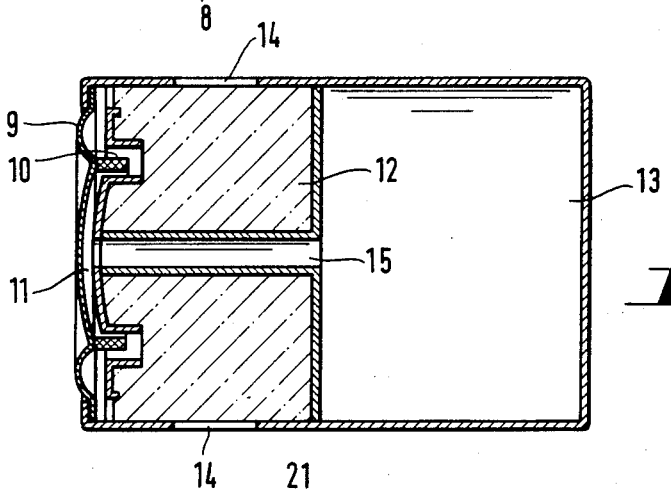
FIG. 2 is a schematic sectional view of an electrodynamic directional microphone according to the invention.

FIG. 2 shows a schematical cross-section of a directional microphone according to the present invention operating in accordance with the electrodynamic principle. The structure of the directional microphone illustrated in FIG. 2 is essentially the same as that of the electrostatic directional microphone shown in FIG. 1. The transducer diaphragm is denoted by reference numeral 9 and supports a moving coil 10. A shallow air chamber 11 is provided behind transducer diaphragm 9. Delay line section 12 as well as the small tube which contains air body 15 acting as an inductance lead into shallow air chamber 11. The other end of the small tube leads to a large-volume hollow space which surrounds an air volume 13 which acts as an acoustic capacitance. This arrangement operates in the same manner as the embodiment described with respect to FIG. 1. Reference numeral 14 denotes the rearward sound entry openings which lead to the delay line section 12.

Figure 3:
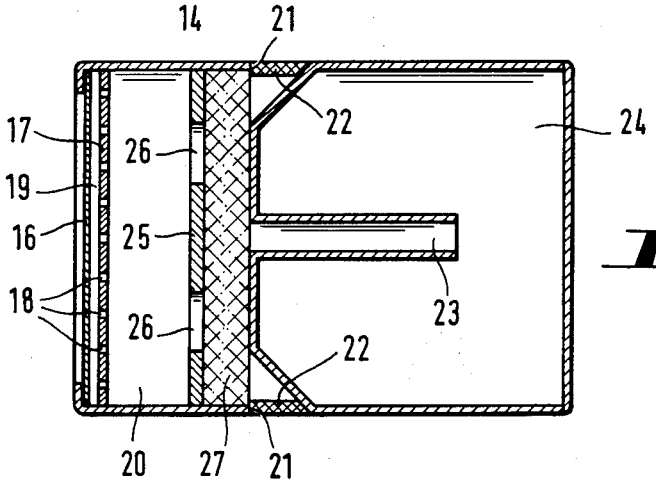
FIG. 3 is a schematic sectional view of another embodiment of a directional capacitor microphone according to the invention.

The embodiment illustrated in FIG. 3 differs from the two embodiments described above in that the additional acoustic elements 23, 24 forming a series resonant circuit are coupled immediately to an element of the delay line section, i.e., a frictional resistance 27. The second acoustic element of the delay line section is formed by a relatively large air chamber 20 provided behind a back plate 17. The back plate 17 has small openings 18 for acoustical connection of the air chamber 20 to the shallow air chamber 19 behind the diaphragm 16. The air volume enclosed within air chamber 20 is to be considered an acoustic capacitance of the delay line section. An intermediate wall 25 with openings 26 forms a further boundary of the air chamber 20. Rearward sound entry openings 21 may be provided with an additional frictional resistance 22. In principle, the series connection of the mass of the air tube 23 with air volume 24 also acts as a short-circuit for the delay line section 20, 22, 27 so that the electrostatic transducer system including the diaphragm 16 and the back plate 17 operates as a pressure pickup below a frequency of about 300 Hz, as is required in accordance with the invention.

Figure 4:
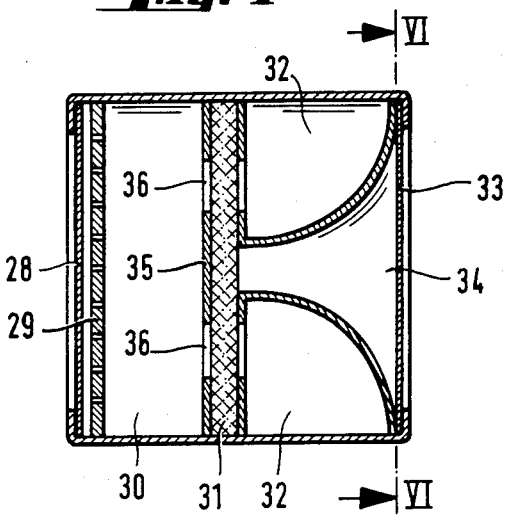
FIGS. 4 and 5 are schematic sectional views of the microphone according to the invention with passive diaphragms.

The embodiment illustrated in FIG. 4 also includes an electrostatic transducer system with a diaphragm 28 and a back plate 29. An air chamber 30 is formed behind back plate 29, as is the case in the embodiment described above. The chamber containing air is bounded relative to the back plate 29 by an intermediate wall 35 which has large openings 36 which permit sound to pass easily therethrough. Behind intermediate wall 35 is arranged a large-area frictional resistance 31 to which is connected a horn-type tube which includes an air volume 34, and a further air volume 32. The large opening of the horn-type tube represents the rearward sound entry opening to the delay line section and is closed off with a passive diaphragm 33. Passive diaphragm 33 is tuned in such a way that it blocks sound entry for frequencies of below approximately 300 Hz, so that the microphone in this range operates as a pressure pickup, as is required according to the invention.

Figure 5:
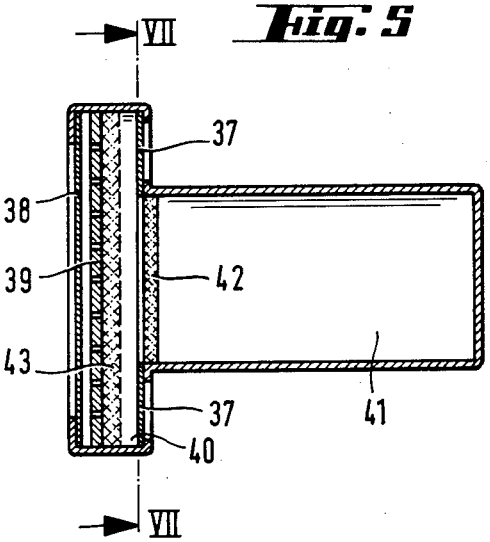

FIG. 5 illustrates an embodiment of the invention which also includes a passive diaphragm 37 which closes off the rearward sound entry opening of the delay line section. The embodiment of FIG. 5 differs from that of FIG. 4 in that the passive diaphragm 37 which closes off the rearward sound entry opening is circular ring-shaped. This circular shape is only possible if the housing including air chamber 41 has a diameter which is smaller than the diameter of the electrostatic transducer system including the diaphragm 38 and back plate 39. Also in this case, the passive diaphragm 37 must be tuned in such a way that it blocks off sound entry from the rear for frequencies of below approximately 300 Hz, so that the microphones operates in this range as a pressure pickup and compensates for the effect of the delay line section. Preferably a layer of an acoustical resistance 43 is provided at the rear side of the back plate 39. A shallow air chamber 40 forms an acoustical coupling for both the passive diaphragm 37 and the frictional resistance 42 leading to the volume 41.

Figure 6:
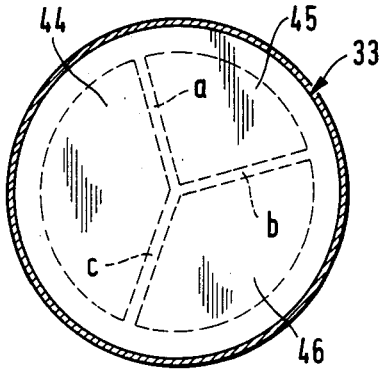
FIGS. 6 and 7 are side views of two different passive diaphragms.

In order to increase the range of effectiveness of the passive diaphragm 33, 37, the diaphragm may be divided into diaphragm portions having different natural resonances. FIG. 6 illustrates such a division for a diaphragm having the area of a circle. Webs a, b and c divide diaphragm 33 into three portions 44, 45, 46. The circular ring-shaped diaphragm 37 illustrated in FIG. 7 may be divided in a similar manner. Webs a, b and c divide the diaphragm 37 into diaphragm portions 47, 48, 49 which, as mentioned above, have different natural resonances. These different natural resonances can be obtained most easily by dividing the diaphragm in such a way that the diaphragm portions have different surface area.

The manner of operation of the invention shall now be described in more detail with the aid of electrical equivalent circuit diagrams.

Figure 8:
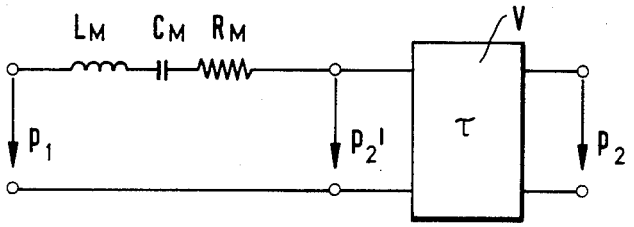
FIGS. 8 to 12 are electrical equivalent circuit diagrams, wherein the at least one delay line section is illustrated merely in the form of a rectangle.

For a better understanding of the present invention, initially a known directional microphone constructed as a pressure gradient pickup shall be described with the aid of the electrical equivalent circuit diagram illustrated in FIG. 8.

Such a known directional microphone has a transducer diaphragm whose mass, stiffness and internal friction may be illustrated as a series connection of an inductance $L_m$, a capacitance $C_M$ and of an ohmic resistance $R_M$ in accordance with the dual relationships existing between acoustic and electrical valves. This series connection is followed by a four-terminal member V which symbolizes the delay line section usually found in pressure gradient pickups. The delay line section has a propagation time $\tau$. The sound pressure acting on the front side of the transducer diaphragm is denoted by $p_1$, while the sound pressure acting on the rearward sound entry opening leading to the delay line section V is denoted by $p_2$.

The delay of the effect of the sound pressure $p_2$ on the rear side of the transducer diaphragm resulting from the delay line section V must be such that, for example, in a directional microphone having a cardioid pickup pattern, the sound pressures $p_1$ and $p_2'$ are equal with respect to amplitude and phase when acoustic irradiation of the microphone takes place from the rear (180° acoustic irradiation). $p_2'$ is that sound pressure which reaches the rear side of the transducer diaphragm after passing through the delay line section V. In this case, the transducer diaphragm does not move and acoustic vibrations are not transposed into electric oscillations. This ideal situation is unattainable in practice because losses will always be suffered in the delay line section. Thus, in the case of a 180° acoustic irradiation of the microphone, a cancellation of the sound waves incident from behind by only 20 dB to 30 dB is obtained. In particularly advantageous cases, values slightly above 30 dB may be obtained.

The above-described known directional microphone operates over the entire range of audibility as a pressure gradient pickup, while the directional microphone according to the invention is to operate as a pressure gradient pickup only in the range above a limit frequency of about 300 Hz. Below the limit frequency mentioned above, the microphone according to the invention is to operate as a non-directional pressure pickup.

Figure 9:
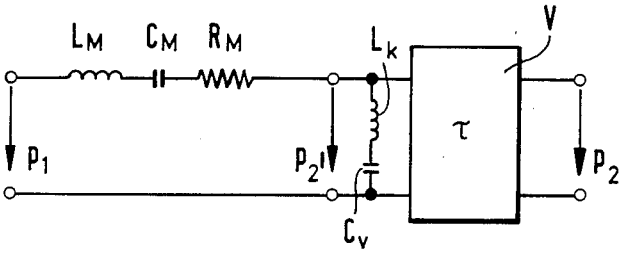

FIG. 9 shows the electrical equivalent circuit diagram of such a microphone. The electrical equivalent circuit diagram of FIG. 9 differs from that of FIG. 8 in that a series resonant circuit is connected parallel to the output of the delay line section V. The series resonant circuit is composed of an inductance $L_k$ and a capacitor $C_v$. This equivalent circuit diagram corresponds to the embodiments illustrated in FIGS. 1 and 2. The series resonant circuit composed of $L_k$ and $C_v$ is dimensioned in such a way that it forms for the frequency range below about 300 Hz a short-circuit parallel to the delay line section V. This means that in this frequency range the delay line section is ineffective and, thus, the microphone operates, as desired, as a non-directional pressure pickup. Due to the losses in the series resonant circuit and possibly by an additional damping, it is possible to obtain a resonant band width of the resonant circuit formed by $L_k$ and Chd v of such a size that it essentially includes the frequency range below about 300 Hz.

However, the transition from pressure gradient pickup to non-directional pressure pickup can also be obtained by means of a capacitance $C_s$ which is arranged in series with the delay line section. In the following, capacitance $C_s$ will be referred to as a blocking capacitance.

Figure 10:
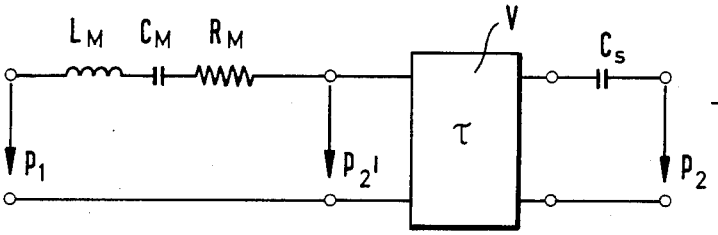

An arrangement of this type is illustrated in FIG. 10, in the form of an electrical equivalent circuit diagram. When the blocking capacitance $C_s$ is sufficiently small, passage of a sound pressure $p_2$ which is incident at 180° acoustic irradiation is blocked by the delay line section for all frequencies which are below the preferred limit frequency of 300 Hz. Thus, sound pressure $p_2$ essentially disappears at the rear side of the transducer diaphragm and the microphone operates in this range as a non-directional pressure pickup. A directional effect of the microphone will occur with increasing fequency only above the aforementioned limit frequencies. The arrangement described above is particularly advantageously used in directional capacitor microphones.

Figure 11:
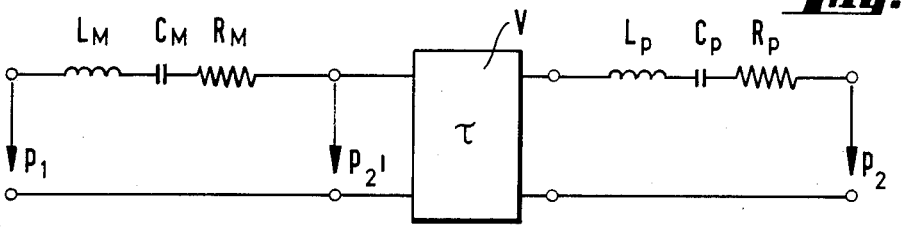
Figure 12:
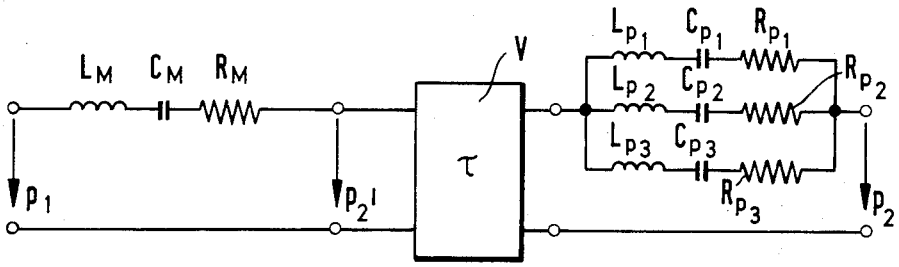

In the electrical equivalent circuit diagram illustrated in FIG. 11, a passive diaphragm is connected in series with the delay line section V. The mass, stiffness and internal friction of the passive diaphragm is represented by the inductance $L_p$, the capacitance $4C_p$ and the ohmic resistance $R_p$, respectively. In principle, this is a damped series resonant circuit having such a dimension that it operates as a high pass filter whose limit frequency is in the range of about 300 Hz. Accordingly, of the sound pressure $p_2$ acting on the rearward sound entry opening only those portions will reach the rear side of the active transducer diaphragm whose frequencies are above the assumed limit frequency of approximately 300 Hz. Consequently, the microphone operates as a non-directional pressure pickup in the case of frequencies below this limit frequency, while the microphone operates as a pressure gradient pickup with defined pickup pattern in the case the frequency is above the limit frequency.

Figure 7:
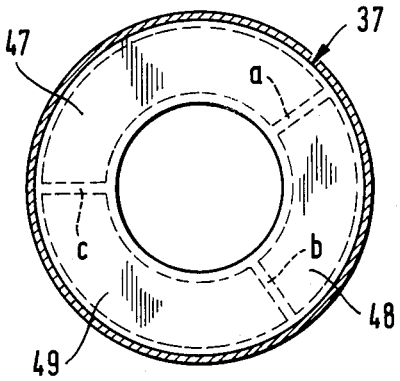

Since it is difficult with only a single passive diaphragm to widen the pass range above 300 Hz without excessive damping to the highest frequencies of the range of audibility, particularly when high demands are made of the microphone, the invention proposes, as described above, to divide the passive diaphragm (denoted in FIGS. 4–7 with reference numerals 33 or 37) which closes the rearward sound entry opening to the delay line section V into diaphragm portions by means of several webs (FIGS. 6 and 7). These diaphragm portions have different natural resonances which are distributed over the pass range.

An arrangement of this type corresponds to the equivalent circuit diaphragm is divided into three diaphragm portions, wherein each of which in the electrical equivalent circuit diagram is illustrated as a series connection of an inductance $L_{p1}$, $L_{p2}$, $L_{p3}$ with a capacitance $C_{p1}$, $C_{p2}$, $C_{p3}$ and a resistance $R_{p1}$, $R_{p2}$, $R_{p3}$, respectively. Each of these series resonant circuits only have to provide a range of about a third of the pass range, wherein the pass ranges of the three portions are adjacent each other. Thus, a substantially lower damping of each individual series resonant circuit is sufficient. Of course, this advantageously affects the entire pass range because, in this case, the total damping is substantially lower than in the case of a single series resonant circuit.

Figure 13:
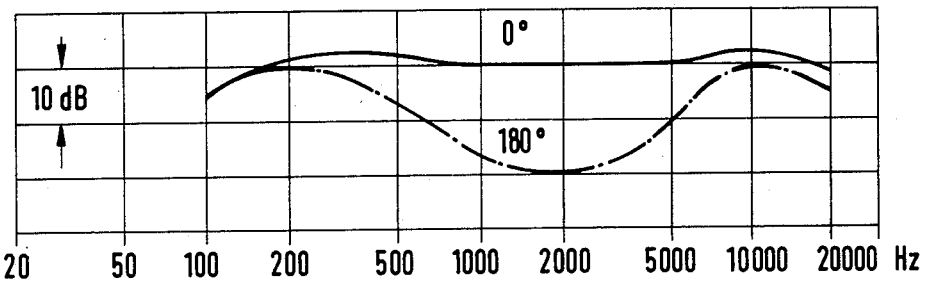
FIG. 13 is a table showing the frequency response of the directional microphone according to FIG. 9 with acoustic irradiations at 0° and 180°.
Figure 14:
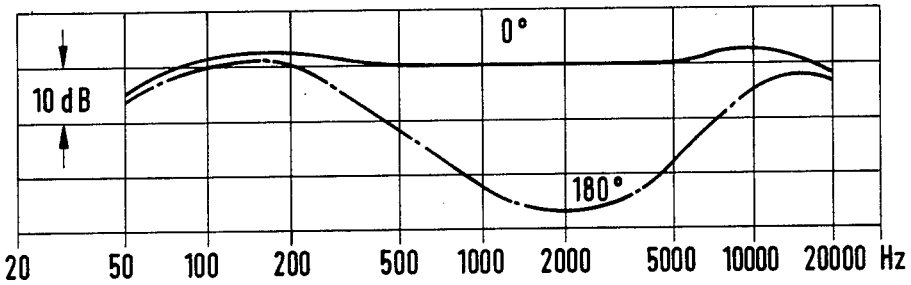
FIG. 14 is a table showing the frequency response of the directional microphone according to FIG. 10 with acoustic irradiations at 0° and 180°.
Figure 15:
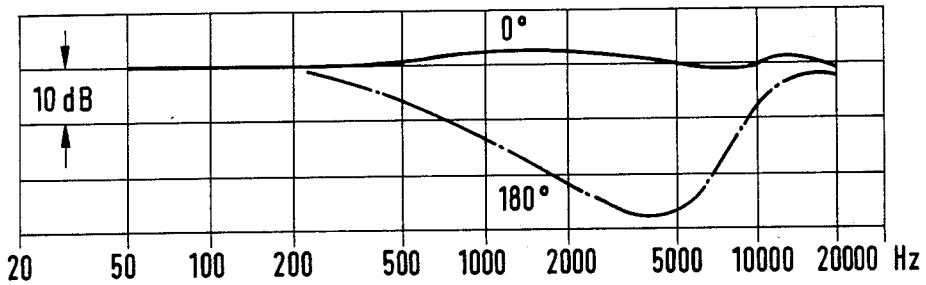
FIG. 15 is a table showing the frequency response of the directional microphone according to FIG. 11 with acoustic irradiations at 0° and 180°.

FIGS. 13, 14 and 15 illustrate frequency responses at 0° and 180° acoustic irradiation of the embodiments of the directional microphone according to the invention illustrated in FIGS. 9, 10 and 11 in the form of equivalent circuit diagrams. As can be seen from FIGS. 13, 14 and 15, the transmission factor in the case of acoustic irradiation from the front (0° acoustic irradiation) essentially varies very little over the entire frequency range, while particularly in the embodiment having one or more passive diaphragms, the transmission factor remains virtually constant. Cancellation (180° acoustic irradiation) above the given limit frequency is sufficiently effective in the known manner.

While the specific embodiments of the invention have been shown and described in detail to illustrate the application of the inventive principles, it will be understood that the invention will be embodied otherwise without departing from such principles.

I claim:

1. A directional microphone operating according to the electrostatic or electrodynamic transducer principle, comprising a housing, an active transducer diaphragm attached to the housing, the housing defining at least one sound entry opening, the at least one sound entry opening located at a distance behind the plane of the active diaphragm, a signal phase-shifting delay line section mounted between the rear side of the active diaphragm and the sound entry opening, and at least one acoustic element adjacent to and acoustically coupled to the delay line section, wherein the delay line section and the at least one acoustic element are arranged to have a lower limit frequency for frequency-proportional phase shifting in the range of 300 Hz.

2. The directional microphone according to claim 1, wherein the delay line section and the at least one acoustic element are connected in series, and wherein the acoustic element is an acoustic capacitance.

3. The directional microphone according to claim 1 wherein the delay line section and the at least one acoustic element are connected in series, and wherein the acoustic element is a passive diaphragm.

4. The directional microphone according to claim1, wherein the housing defines an air chamber adjacent the active diaphragm and a large-volume hollow space at the side of the housing facing away from the active diaphragm, wherein the at least one acoustic element is a series connection of an accoustic inductance and an acoustic capacitance, the acoustic inductance being defined by a body of air enclosed within a small tube, the small tube, together with the delay line section, being in communication with the air chamber, and the air chamber being in communication with the hollow space.

5. The directional microphone according to claim 1, wherein the housing defines a large-volume hollow space facing away from the active diaphragm, wherein the at least one acoustic element is a series connection of an accoustic inductance and an acoustic capacitance, the acoustic inductance being a body of air enclosed within a small tube, the small tube being in communication with the delay line section and the large-volume hollow space.

* * * * *